United States Patent [19]

Okada et al.

[11] 3,981,271

[45] Sept. 21, 1976

[54] MAGNETIC BRUSH TYPE DEVELOPER FOR USE IN AN ELECTROPHOTOGRAPHIC MACHINE

[75] Inventors: Ryuzo Okada; Toshio Nagashima; Hidetoshi Kito; Takuzo Tsukamoto; Michiharu Nakaguchi; Kenichi Handa, all of Ebina, Japan

[73] Assignee: Fuji Xerox Co., Ltd., Tokyo, Japan

[22] Filed: Feb. 18, 1975

[21] Appl. No.: 550,562

[30] Foreign Application Priority Data

Feb. 20, 1974 Japan ..... 49-19615[U]

[52] U.S. Cl. ..... 118/637

[51] Int. Cl.[2] ..... G03G 15/09

[58] Field of Search ..... 29/132; 118/637; 427/18; 355/3 DD

[56] References Cited

UNITED STATES PATENTS

| | | | |
|---|---|---|---|
| 2,701,765 | 2/1955 | Codichini et al. | 118/637 |
| 2,717,080 | 9/1955 | Anderson | 118/637 |
| 2,786,439 | 3/1957 | Young | 118/637 |
| 2,786,440 | 3/1957 | Giaimo, Jr. | 118/637 |
| 3,176,652 | 4/1965 | Mott et al. | 118/637 |
| 3,455,276 | 7/1969 | Anderson | 118/637 |
| 3,669,072 | 6/1972 | Reynolds et al. | 118/637 |
| 3,739,749 | 6/1973 | Kangas et al. | 118/637 |
| 3,828,730 | 8/1974 | Yamashita et al. | 118/637 |

*Primary Examiner*—Mervin Stein
*Assistant Examiner*—Douglas Salser
*Attorney, Agent, or Firm*—Gerald J. Ferguson, Jr.; Joseph J. Baker

[57] ABSTRACT

A magnetic brush developer for use in electrophotographic copiers or the like, the developer comprising a magnet support shaft fixedly mounted with respect to the copier; a hollow, cylindrical magnet fixedly mounted on the support shaft; a hollow cylinder rotatably, concentrically mounted about the cylindrical magnet, the cylinder having at least one side, the one side including an annular support member for the cylinder where the support member is rotatably mounted on the magnet support shaft and projects inside of the cylinder to thereby provide a compact arrangement for the developer.

3 Claims, 5 Drawing Figures

MAGNETIC BRUSH TYPE DEVELOPER FOR USE IN AN ELECTROPHOTOGRAPHIC MACHINE

BACKGROUND OF THE INVENTION

1. Field of the Invention

This invention relates to a magnetic brush type image developer for developing an electrostatic latent image and, in particular, to a stationary magnet/rotary cylinder type magnetic brush image developer.

2. Discussion of the Prior Art

The magnetic brush image developer was originally proposed by C. J. Young in 1957 in U.S. Pat. Nos. 2,786,439 and 2,786,440. The magnetic brush image developer uses a developing agent consisting of iron powder and a toner. A "bristle" is formed by magnetic lines of force of a magnet to thereby rub the surface of a photoconductive layer with the developing agent and thus develop the electrostatic latent image. Magnetic brush image developing devices are generally classified into rotary magnet types and fixed magnet/rotary cylinder types. This invention particularly relates to the latter type, that is, the invention has as a primary object the provision of a compact fixed magnet/rotary cylinder type magnetic brush image developer.

In general, a magnetic brush image developer of the fixed magnet/rotary cylinder type has, as shown in FIG. 1, a magnet *d* of rectangular cross-section mounted by a supporting member *c* between a pair of opposingly disposed shafts *b*, *b'* which are fixedly supported on stationary structures *a*, *a*. A cylinder *e* is disposed around magnet *d* and driven from a suitable driving means *f* to rotate it about magnet *d*. For this purpose, it is necessary to provide a sufficient space at opposite ends of the afore-mentioned supporting member *c* for mounting the shafts *b*, *b'*. Further, rectangular magnet *d* has a magnetic flux density distribution as shown by the dotted line in FIG. 3, from which it can be seen that the opposite ends have a defective rise characteristic. Therefore rectangular magnet *d* has a limited effective developing range, that is, magnet *d* has to have a relatively long length $l_2$ in order to develop a copy sheet of A4 size whose width is represented by *l*. Because of these limiting factors, it has been difficult to construct a compact, fixed magnet/rotary cylinder type magnetic brush image developer.

SUMMARY OF THE INVENTION

The present invention overcomes the afore-mentioned difficulties and makes it possible to reduce the length of the magnet per se by using a magnet of a cylindrical shape instead of a magnet of a rectangular cross-section and to replace the supporting member *c*, which has thus far been an essential element, with a cylinder supporting member bent inwardly of the cylindrical magnet, as will be described in more detail hereinafter, thus reducing the size of the developer apparatus to a considerable degree.

This and other objects of the invention will become more readily apparent upon reading the specification and claims taken with the drawing.

DETAILED DESCRIPTION OF THE PREFERRED EMBODIMENT

Figure 1:
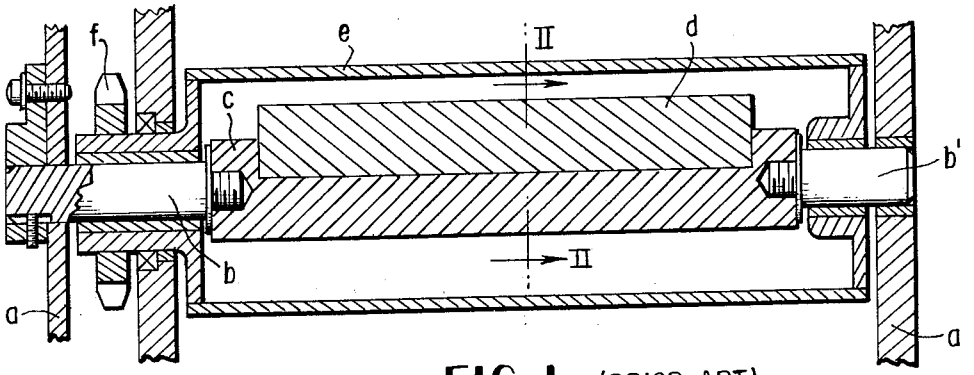
FIG. 1 (PRIOR ART)
FIG. 1 is a sectional view of a prior art magnetic brush developing apparatus.
Figure 2:
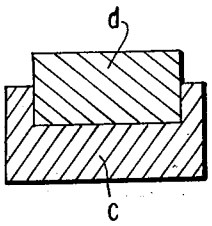
FIG. 2 is a sectional view taken along line II—II of FIG. 1.
Figure 4:
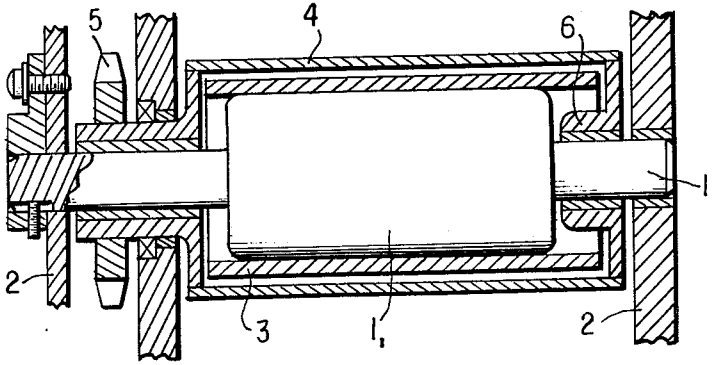
FIG. 4 is a sectional view of an illustrative magnetic brush developer in accordance with the present invention.

FIG. 4 shows a preferred embodiment of the present invention, where the width *l* of the effective developing area and the support and drive means for the cylinder are the same as those for the prior art existing developing apparatus shown in FIG. 1. A comparison of FIG. 1 with FIG. 4 will clarify the advantages obtained by the present invention.

Referring to FIG. 4, there is shown a magnet support shaft 1 which is fixedly supported on a stationary structure such as the body structure 2 of a duplicating machine. The magnet support shaft 1 is formed with a larger diameter portion $1_1$, which has fitted therearound a cylindrical magnet 3. The cylindrical magnet 3 is housed in an outer cylinder 4 which is adapted for rotation by a suitable drive means 5. The end of cylinder 4 opposite from drive means 5 is supported by a support member 6 which is bent and inserted into the interior of the cylindrical magnet 3, as shown in FIG. 4.

Figure 3:
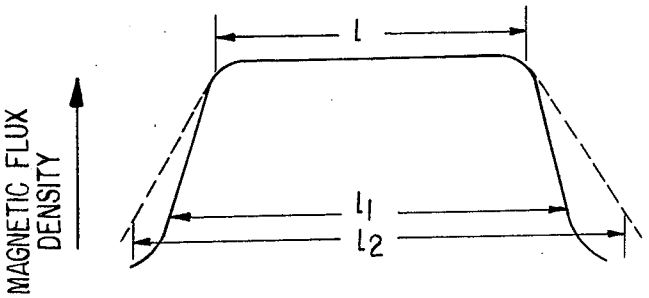
FIG. 3 is a graphical representation of the magnetic flux density distribution of the magnets of FIGS. 1 and 4.

With the construction as described above, the magnetic flux of cylindrical magnet 3 is distributed as indicated by the solid line curve of FIG. 3. In order to ensure an effective developing width of *l*, the cylindrical magnet only has to have a length $l_1$ which is substantially smaller than the length $l_2$ which is necessary to attain the same effective developing width with the conventional rectangular magnet.

Figure 5:
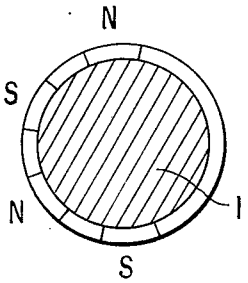
FIG. 5 is a sectional view of an illustrative magnetizing pattern of the cylindrical magnet of FIG. 4.

The magnetizing pattern of the cylindrical magnet 3 can be predetermined in various ways depending upon actual usuage and one example of a magnetizing pattern is shown diagramatically in FIG. 5.

The magnetic brush image developer of the invention having the construction as described hereinbefore has substantially great practical advantages such as the provision of a magnetic brush image developer of a considerably compact size when compared with existing developers.

What is claimed is:

1. A magnetic brush developer for use in electrophotographic copiers or the like, said developer comprising a magnet support shaft fixedly mounted with respect to said copier;

a hollow, cylindrical magnet fixedly mounted on said support shaft;

a hollow cylinder rotatably, concentrically mounted about said cylindrical magnet, said cylinder having at least one side, said one side including an annular support member for said cylinder where said support member is rotatably mounted on said magnet support shaft and projects inside of said cylindrical magnet to thereby provide a compact arrangement for said developer.

2. A magnetic brush developer comprising a cylindrical magnet mounted on a magnet support shaft which is fixedly supported on a stationary structure;

a cylinder rotatably mounted about said cylindrical magnet and having at least one side thereof supported on said magnet support shaft by means of a supporting member which is bent inwardly of said cylindrical magnet.

3. A magnetic brush developer for use in electrophotographic copiers or the like, said developer comprising a magnet support shaft fixedly mounted with respect to said copier;

a hollow, cylindrical magnet fixedly mounted on said support shaft, said magnet support shaft having an enlarged cylindrical, inner portion for mounting said hollow, cylindrical magnet;

a hollow cylinder rotatably, concentrically mounted about said cylindrical magnet, said cylinder having at least one side, said one side including an annular support member for said cylinder where said support member is rotatably mounted on said magnet support shaft and projects inside of said cylindrical magnet to thereby provide a compact arrangement for said developer.

* * * * *